US006245436B1

(12) United States Patent
Boyle et al.

(10) Patent No.: US 6,245,436 B1
(45) Date of Patent: Jun. 12, 2001

(54) SURFACING OF ALUMINUM BODIES BY ANODIC SPARK DEPOSITION

(76) Inventors: David Boyle, 5240 S. M52, Stockbridge, MI (US) 49285; David Robert Collins, 14903 Forest, Southgate, MI (US) 48195; Oludele Olusegun Popoola, 29906 Windsor Ct., Novi, MI (US) 48377; Paul Earl Pergande, 20750 Smallwood Ct., Beverly Hills, MI (US) 48025; Tony Leung Wong, 1019 Granger, Ann Arbor, MI (US) 48104

( * ) Notice: Subject to any disclaimer, the term of this patent is extended or adjusted under 35 U.S.C. 154(b) by 0 days.

(21) Appl. No.: 09/246,875

(22) Filed: Feb. 8, 1999

(51) Int. Cl.[7] ..... B32B 15/20
(52) U.S. Cl. ..... 428/472.2
(58) Field of Search ..... 205/324, 325, 205/327, 328, 329, 330, 331, 332, 333, 106, 107, 108, 139, 153; 204/50; 422/186.06, 186.21; 428/469, 472.1, 472.2

(56) References Cited

U.S. PATENT DOCUMENTS

| | | | | |
|---|---|---|---|---|
| 3,862,892 | | 1/1975 | Lautenschlager et al. | 204/58 |
| 4,276,007 | | 6/1981 | Sakamaki et al. | 418/152 |
| 5,094,727 | * | 3/1992 | Schwarz et al. | 205/322 |
| 5,385,662 | | 1/1995 | Kurze et al. | 205/316 |
| 5,487,825 | * | 1/1996 | Kurze et al. | 205/200 |
| 5,980,723 | * | 11/1999 | Runge-Marchese et al. | 205/316 |

OTHER PUBLICATIONS

Hubner and Schiltknecht: The Practical Anodising of Aluminum, p. 24, No month available/1960.*

* cited by examiner

*Primary Examiner*—Kathryn Gorgos
*Assistant Examiner*—Thao Tran

(57) ABSTRACT

Aluminum or aluminum alloy bodies, such as cast fuel pump bodies, are subjected to anodic spark deposition under deposition conditions in an electrolyte effective to form an surface layer that is enriched in alpha alumina to improve surface hardness and that includes a substantially uniform distribution of lubricant-retaining, nanosize surface pores.

4 Claims, 2 Drawing Sheets

50x

2000x

50x

1000x

SURFACING OF ALUMINUM BODIES BY ANODIC SPARK DEPOSITION

BACKGROUND OF THE INVENTION

1. Field of the Invention

The invention relates to treatment of aluminum and aluminum alloy bodies by anodic spark deposition to form a novel lubricant-retaining and mechanically durable surface layer.

2. Description of Related Art

Fuel pump bodies commonly used to supply fuel to internal combustion engines now are made of hard-anodized and water-sealed cast aluminum alloys. For example, an anodized coating thickness of 18 microns, anodized surface roughness of 1.0 micron $R_a$, and anodized surface hardness of about 250 Hv are specified for certain vehicle cast aluminum alloy fuel pump bodies. Fuel pumps including such hard-anodized and water-sealed pump bodies generally are replaced at least once in the lifetime of most vehicles as a result of the pump body caused by abrasive deposits and fuel impurities. Such abrasive wear occurs as a result of insufficient hardness of the anodized surface layer formed on the cast pump body. In particular, conventional hard anodizing has been found to generally produce a mixture of crystalline and amorphous alumina on the anodized surface with significant amounts of layer porosity even after a water sealing treatment whereby the anodized surface exhibits insufficient hardness and wear resistance.

There thus is a need for a surface treatment for fuel pump bodies made of aluminum and its alloys to impart improved surface hardness and wear resistance thereto.

SUMMARY OF THE INVENTION

An object of the present invention is to satisfy this need by subjecting an aluminum or aluminum alloy body to anodic spark deposition under deposition conditions in an electrolyte effective to form a surface layer that is enriched in alpha alumina to improve surface hardness and that includes lubricant-retaining surface pores distributed across an outer surface of the layer. The surface layer may be doped in-situ during deposition with a solid state lubricant. Aluminum or aluminum alloy bodies, such as fuel pump bodies discussed above, having such a surface layer formed thereon exhibit improved wear resistance as compared to conventional hard-anodized and water-sealed aluminum or aluminum alloy bodies.

DETAILED DESCRIPTION OF THE PREFERRED EMBODIMENT

An embodiment of the invention involves subjecting an aluminum or aluminum alloy body, such as for example only, an aluminum alloy fuel pump body, to anodic spark deposition (hereafter ASD) under deposition conditions in an electrolyte effective to form an surface layer that is enriched in alpha alumina to improve surface hardness and that includes a uniform distribution of lubricant-retaining, nano-size pores across the surface layer. Typical ASD apparatus comprises a body (substrate) to be coated (anode), a cathode comprising such materials as steel, platinum or carbon, and an electrical power supply unit with cooling coils. ASD apparatus is described by G.P. Wirth et al. in Materials and Manufacturing Processes 6(1), 87 (1991). The electrical power can be supplied as DC or AC mode using sinusoidal or square wave forms. The ASD process generally can be divided into three regimes; namely, 1) anodization, 2) dielectric breakdown, and 3) coating build-up. The anodization regime occurs as an early process stage and produces a barrier film that impedes electron transport across the anode/electrolyte interface, thereby reducing electrical current over time. At sufficiently high voltages, a dielectric breakdown of the barrier layer occurs and sparking occurs at the anode surface, creating fresh surfaces on which desired oxide coatings can form. The sparks are thought to be due to electron avalanches through the barrier layer. The surface sparks create high local surface temperatures sufficient for formation of alpha alumina, which is a thermally stable phase of alumina. The dielectric breakdown regime generally occurs at multiple points on the anode surface, and the sparks can be seen to travel along the anode surface as deposition of the oxide surface layer occurs. During this regime, electrical current increases with time. As the desired oxide coating thickens in the coating build-up regime, coating resistance to current flow increases such that the electrical current decays over remaining time of the ASD process.

Figure 4:
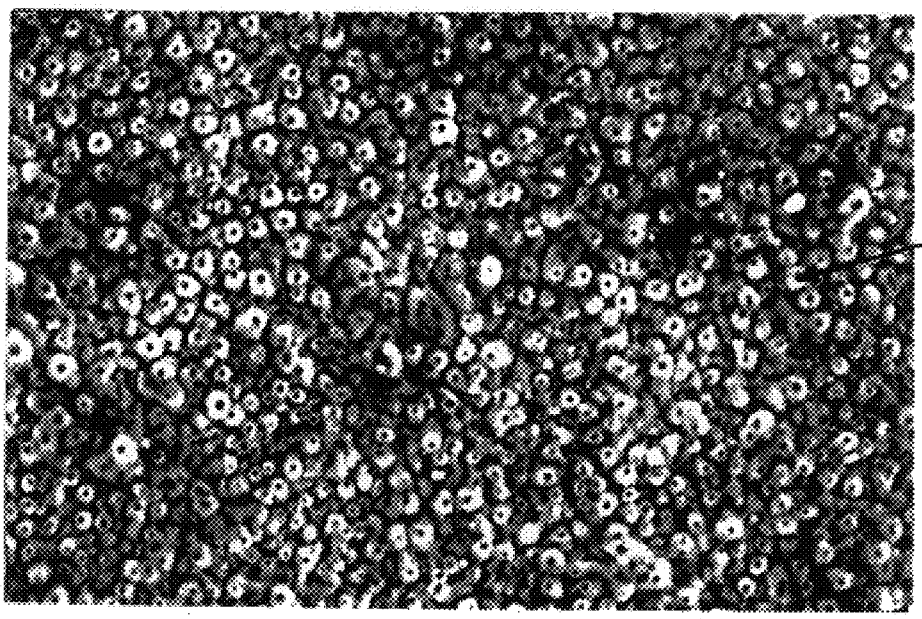

In practicing an embodiment of the invention, the electrolyte composition and deposition conditions (e.g. voltage and electrical current) are selected to form an aluminum oxide surface layer or coating having a novel surface morphology illustrated, for example, in FIG. 4, where the aluminum oxide surface layer includes nano-size surface pores P uniformly distributed on and across an outer free surface of the alumina layer. The nano-size pores P connect to the outer surface of the alumina layer but do not extend to the substrate. Nano-size pores in the context of the invention include pores having a lateral dimension, when viewed normal to the oxide surface layer, of less than 1 micron (1000 nanometers).

Electrolyte compositions which can be used to practice the invention include an organic solvent and a conductivity-controlling agent dissolved in the solvent. A pH-controlling agent also typically is included in the organic solvent to control the electrolyte pH near a neutral pH value, such as for example from about 6.9 to about 8, preferably about 6.9 to about 7.1. An optional doping agent also can be present in the electrolyte to in-situ dope the surface layer with a refractory metal, such as Mo, W and the like, for lubricity purposes. The dopant is incorporated into the surface layer as a solid state lubricating substituent. Electrolyte temperature typically is maintained at ambient room temperature or slightly above (e.g. to 50° C.). Although the examples set forth below describe the electrolyte as comprising ethyl diamine as the organic solvent, $KH_2PO_4$ as the conductivity-controlling agent, $NH_4OH$ as the pH controlling agent, and compounds of Mo and W as doping agents, the invention is not so limited and can be practiced using other solvents, conductivity-controlling agents, pH-controlling agents, and doping agents.

In practice of the invention, the ASD voltage and electrical current parameters are controlled in dependence on the electrolyte composition. Particular voltage and current parameters chosen for the electrolyte compositions used in the examples set forth below are described to provide anode/cathode sparking effective to form the aluminum oxide surface layer described having the aforementioned improved surface hardness and novel surface pore morphology. The invention can be practiced using a constant voltage with variable current or constant current with variable voltage controlled in a manner to achieve anode/cathode sparking and gas generation (e.g. $H_2$, $CO_2$) at the surface of the body (anode) during coating deposition believed to produce the novel nano-size surface pore morphology, although Applicants do not wish or intend to be bound or limited to this explanation. The invention is not limited to the particular voltage and current parameters set forth in the examples and can be practiced using other ASD voltage and current values depending upon the electrolyte composition.

The following examples are offered to further illustrate, but not limit, the invention, and involve forming alpha alumina ($Al_2O_3$), Mo-doped alpha alumina, and W-doped alpha alumina on cast ACD6 aluminum alloy fuel pump bodies (ACD6 alloy composition, in weight %, is 1% max Si, 2.5–4.0% Mg, 0.1% Cu, 0.4% max Zn, 0.8% max Fe, 0.4% max Mn, 0.1% max Ni, 0.1% max Sn and balance Al). The cast ACD6 aluminum alloy fuel pump bodies had an initial (uncoated) absolute surface roughness ($R_a$) of 0.8 to 1.1 micron $R_a$ and an initial (uncoated) Vickers hardness, ($H_v$), of 90 $H_v$. The ASD treated pump bodies were tested for surface hardness and wear resistance.

For comparison purposes, a conventional hard-anodized and water sealed fuel pump body of the same ACD6 aluminum alloy also was tested for surface hardness and wear resistance. The hard-anodized and water sealed fuel pump body exhibited an initial (uncoated) surface roughness of 0.8 to 1.1 micron $R_a$ and a surface hardness of 300$H_v$ and was anodized using conventional sulfuric acid electrolyte to form a surface layer which was conventionally water sealed.

The undoped alumina ($Al_2O_3$) surface layer was formed on the pump body using an electrolyte comprising 80 grams of $KH_2PO_4$, 25 ml of $NH_4OH$ (35%), and 50 mL of ethyl diamine (50%) all in one liter of solution maintained at about room temperature. Deposition of the alpha alumina surface layer was effected using a voltage of 260 to 300V that was varied during deposition to provide an electrical current of 2–10 Amperes and resultant anode/cathode sparking and gas generation at the anode surface during coating deposition. In this and the other examples, the cathode comprised a cylindrical steel electrolyte tank in which a pump body to be coated was immersed, providing a spacing between the anode (pump body) and cathode (tank) in the range of 0.1 to 1 inch. The coating produced was 15 microns thick, had a surface roughness of 0.8 to 1.1 microns $R_a$ and a microhardness of 450 $H_v$. The deposition rate was about 1 to 2 micron coating thickness per minute.

The Mo-doped alumina ($Al_2O_3$) surface layer was formed on the pump body using an electrolyte comprising 80 grams of $KH_2PO_4$, 25 ml of $NH_4OH$ (35%), 50 mL of ethyl diamine (50%), and 1.5 grams of $(NH_4)_2MoO_4$ (doping agent) all in one liter of solution maintained at about room temperature. Deposition of Mo-doped alpha alumina surface layer was effected using a voltage of 280 to 320V varied to provide a electrical current of 2–10 Amperes and resultant anode/cathode sparking and anode gas generation during coating deposition. The coating produced was 19 microns thick, had a surface roughness of 0.8 to 1.1 microns $R_a$, and a microhardness of 420 $H_v$. The deposition rate was about 3 microns coating thickness per minute.

The W-doped alumina ($Al_2O_3$) surface layer was formed on the pump body using an electrolyte comprising 80 grams of $KH_2PO_4$, 25 ml of $NH_4OH$ (35%), 50 mL of ethyl diamine (50%), and 0.5 mole of $Na_2WO_4$ (doping agent) all in one liter of solution maintained at about room temperature. Deposition of Wo-doped alpha alumina surface layer was effected using a voltage of 250 to 290V varied to provide an electrical current of 1.5–5 Amperes and resultant anode/cathode sparking and anode gas generation during coating deposition. The coating produced was 13 microns thick, had a surface roughness of 0.8 to 1.2 microns $R_a$, and a microhardness of 390 $H_v$. The deposition rate was about 1 to 2 microns coating thickness per minute.

Generally, the present invention envisions using a voltage in the range of about 250 to about 350 V and electrical current in the range of about 1 to about 15 Amperes with the electrolyte described above to achieve an alumina surface layer in accordance with the invention.

Figure 3:
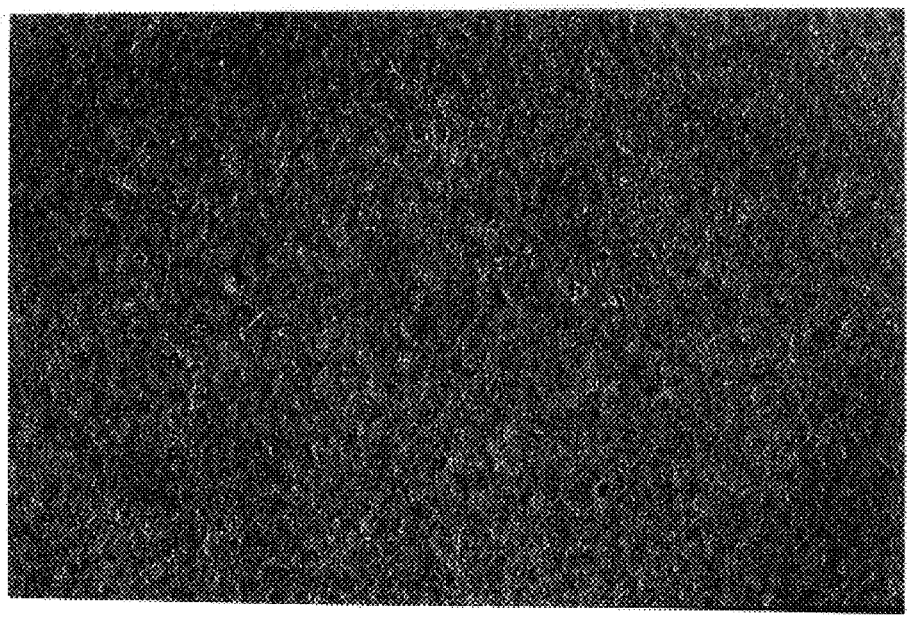
FIGS. 3 and 4 are photomicrographs at 50X and 1000X, respectively, of a surface layer formed on an aluminum alloy fuel pump body using anodic spark deposition pursuant to an embodiment of the invention.

FIGS. 3 and 4 are photomicrographs of surface layer morphologies of the ASD undoped alumina coated pump bodies pursuant to the invention, the Mo-doped and W-doped alumina coatings exhibited similar surface morphologies. From FIGS. 3 and 4, it is apparent that no spherulites or poorly crystallized phases were observed at the ASD surface layer.

Figure 1:
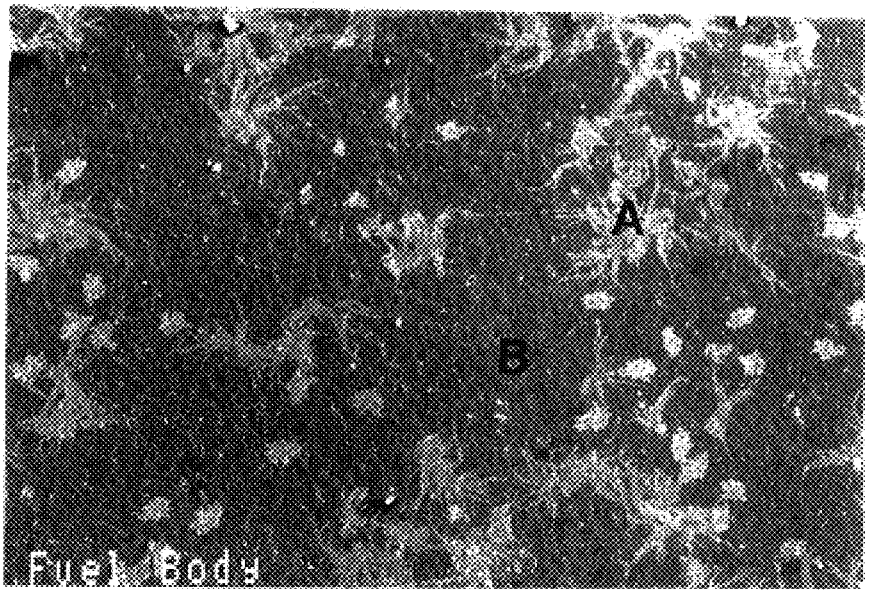
FIG. 1 (PRIOR ART)
FIGS. 1 and 2 are photomicrographs at 50X and 2000X, respectively, of a surface layer formed on an aluminum alloy fuel pump body using a conventional hard-anodizing and water-sealing treatment.
Figure 2:
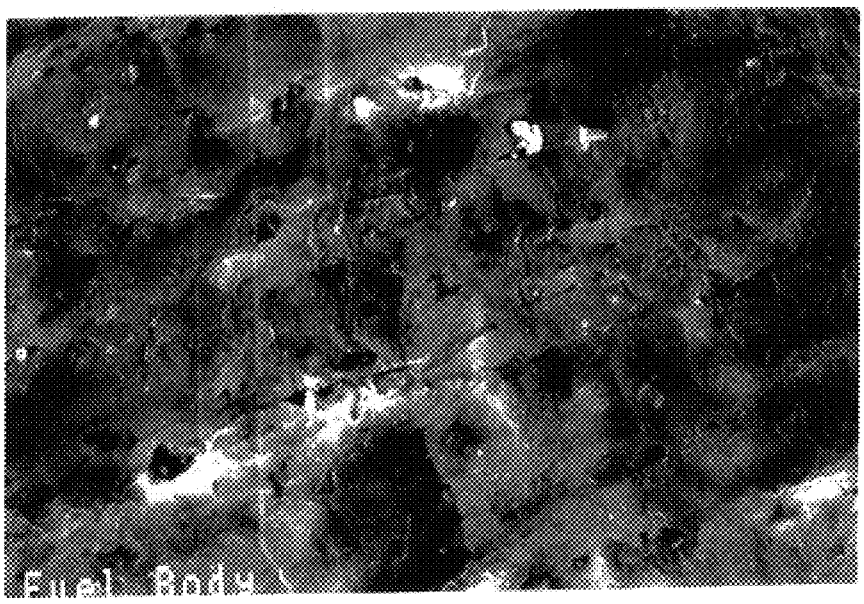
FIG. 2 (PRIOR ART)

In contrast, FIGS. 1 and 2 illustrate the comparison hard-anodized and water-sealed surface layer on the ACD6 aluminum alloy pump body where the anodized surface is microscopically rough (area B) with deposits (areas A). The white patches or deposits (areas A) comprise poorly crystallized alumina hydrates with spherultic structures. FIG. 2 is a higher magnification of area B and reveals an uneven surface layer with irregularly shaped and unevenly distributed pores having a lateral pore dimension of 1 to 2 microns.

Although the anodic surface layer in FIGS. 3 and 4 is not fully crystallized (fully crystallized alpha alumina surface will have a hardness in excess of 1000 $H_v$), the fraction of alpha alumina in the ASD coating on the pump bodies was substantially increased as evidenced by the increase in hardness set forth in Table I below. Moreover, the ASD coatings or surface layers include uniformly distributed nano-size surface pores P having a lateral pore dimension, when viewed normal to the surface layer, of about 0.10 micron to about 0.15 micron. The nano-size pores are evenly distributed across the outer surface of the alumina layer and connect to the outer surface. The pores do not extend through the coating thickness such that they do not reach the substrate. The novel nanopore morphology achieved favors retention of a permanent liquid lubricant film at the surface layer during pump operation to separate the pump rotor from the pump housing.

The performance of various other ASD coated pump bodies (coated using ASD parameters similar to those described above) was evaluated using fuel pump validation testing procedures for surface roughness, microhardness, wear volume, and flow loss. The procedure consisted of operating fuel pumps assembled using the ASD coated pump bodies under various flow pressures for 3000 hours. Flow losses, indicative of pump wear, were monitored over time. After 3000 hours, the pumps were disassembled and the wear was measured using profilometry. A fuel pump was assembled using a comparison conventional hard anodized and water-sealed pump body for like testing. The results of the pump testing are set forth in Table I.

TABLE I

| | Surface Roughness Ra (um) | micro hardness (Hv) | Wear Volume after 3000 hrs test ($mm^3$) | Flow loss (liter/hr) |
|---|---|---|---|---|
| Hard-anodized & Water Sealed | 0.83–1.1 | 350 | 73.4 | 13.2 |
| Mo-doped ASD $Al_2O_3$ | 0.80–1.1 | 480 | 3.16 | 3.9 |
| W-doped ASD $Al_2O_3$ | 0.84–1.2 | 390 | 24.4 | 0.2 |
| ASD $Al_2O_3$ | 0.8–1.1 | 520 | 4.88 | 0.2 |
| Virgin sample (neither anodized nor ASD coated) | 0.8–1.1 | 90 | n/a | n/a |

n/a = not available

It is apparent that the various ASD coated pump bodies coated pursuant to the invention exhibited substantially higher Vickers surface microhardness and substantially lower wear volume and flow loss over time as compared to the conventional hard-anodized and water sealed or virgin (untreated) pump bodies. The undoped alumina and Mo-doped alumina ASD coated pump bodies were especially improved in surface hardness and wear resistance. The observed substantial increase in surface hardness of the ASD coated pump bodies coupled with the favorable nano-sizes and uniform distribution of pores in the ASD coatings resulted in substantially less wear in Table I as compared to the conventional hard-anodized and water-sealed pump body, thereby providing the possibility for improving life of the coated fuel pump bodies in service in a vehicle.

While the invention is described above in terms of specific embodiments, it is not intended to be limited thereto but rather only to the extent set forth in the following claims.

What is claimed is:

1. A fuel pump body comprising aluminum, said fuel pump body having a hard and wear resistant anodic spark deposited layer thereon, said anodic spark deposited layer comprising aluminum oxide and a refractory metal, said layer having a substantially uniform distribution of nano-size surface pores.

2. The body of claim 1 wherein said pores have a lateral pore dimension of less than 1 micron.

3. The body of claim 1 wherein said lateral dimension of individual pores is from 0.10 to 0.15 micron.

4. The body of claim 1 wherein said layer includes a refractory metal incorporated therein as a solid state lubricant.

* * * * *